United States Patent [19]

Taylor, Jr.

[11] 4,001,954

[45] Jan. 11, 1977

[54] SHOE CONSTRUCTION

[75] Inventor: Kennedy G. Taylor, Jr., Nashville, Tenn.

[73] Assignee: Genesco, Inc., Nashville, Tenn.

[22] Filed: May 19, 1975

[21] Appl. No.: 578,483

[52] U.S. Cl. ..... 36/16; 36/19 R

[51] Int. Cl.[2] ..... A43B 9/10; A43B 13/28

[58] Field of Search ..... 36/83, 9 R, 9 A, 16, 36/21, 19 R, 19 A

[56] References Cited

UNITED STATES PATENTS

| | | | |
|---|---|---|---|
| 1,891,064 | 12/1932 | Simonovitz | 36/16 |
| 2,721,401 | 10/1955 | Belyea | 36/16 |
| 3,345,762 | 10/1967 | Fisher et al. | 36/9 R |

FOREIGN PATENTS OR APPLICATIONS

| | | | |
|---|---|---|---|
| 1,054,485 | 2/1954 | France | 36/16 |
| 892,727 | 8/1953 | Germany | 36/16 |

*Primary Examiner*—Patrick D. Lawson
*Attorney, Agent, or Firm*—Harrington A. Lackey

[57] ABSTRACT

A shoe construction including an upper having a forepart marginal flange secured to the corresponding marginal portion of the forepart of an insole, and an elongated binding tape extending the length of the periphery of the forepart of the shoe folded over and secured to the flange and the bottom face of the marginal portion of the insole to provide a welt-look. The shoe also preferably includes a padded member secured to the upper face of the forepart of the insole by a cover sheet, the margins of which are secured to the marginal portion of the insole and between the insole and the flange of the upper.

6 Claims, 19 Drawing Figures

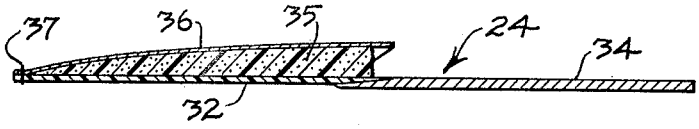
Fig. 3
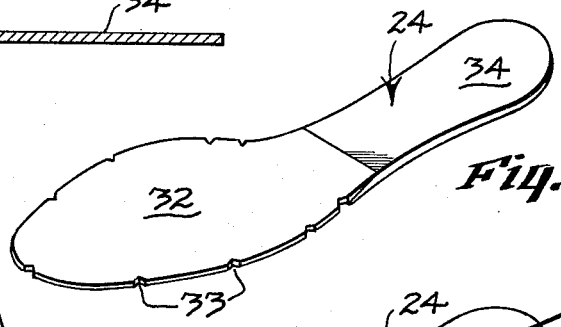
Fig. 1
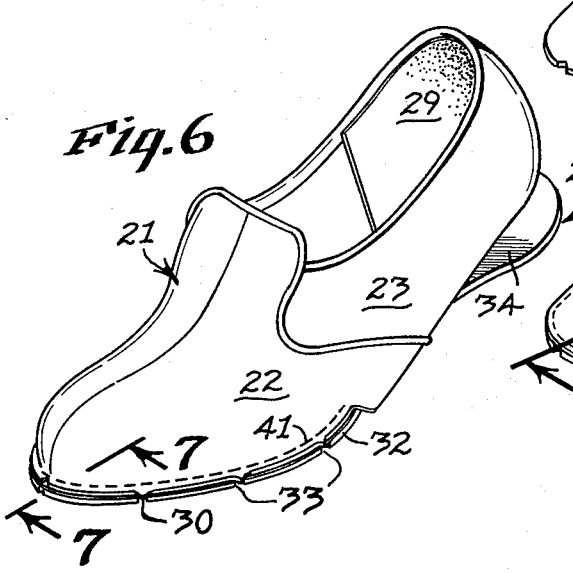
Fig. 6
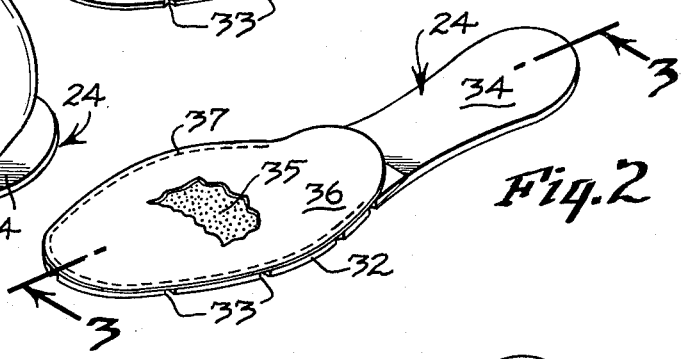
Fig. 2
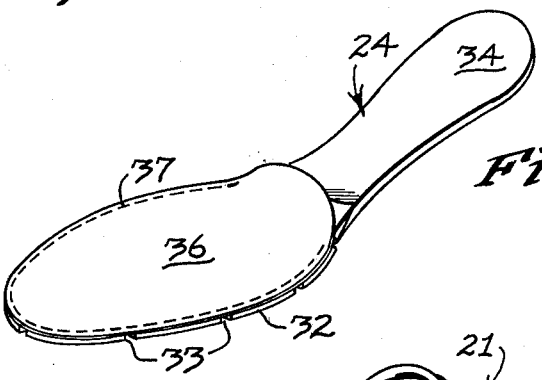
Fig. 4
Fig. 7
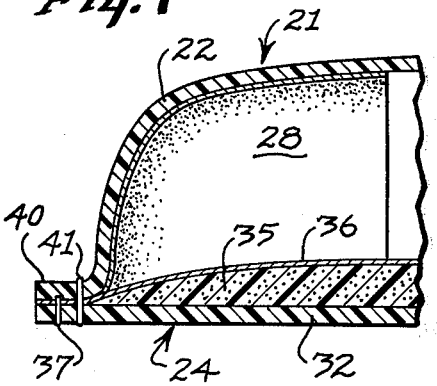
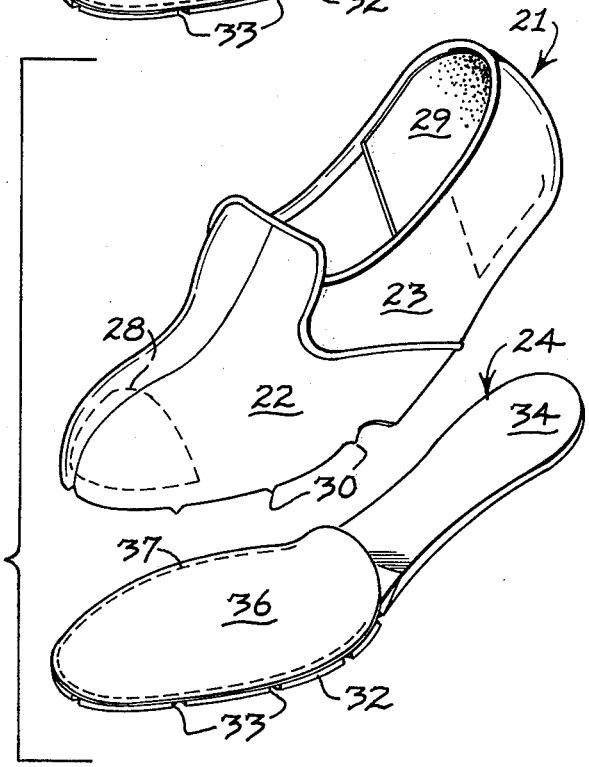
Fig. 5

Fig. 9
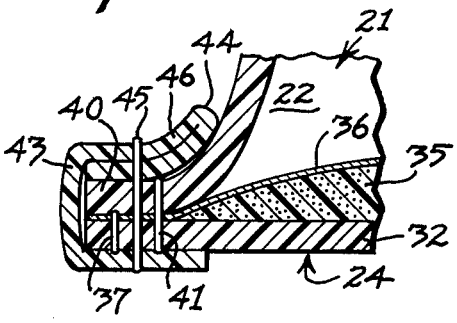
Fig. 8
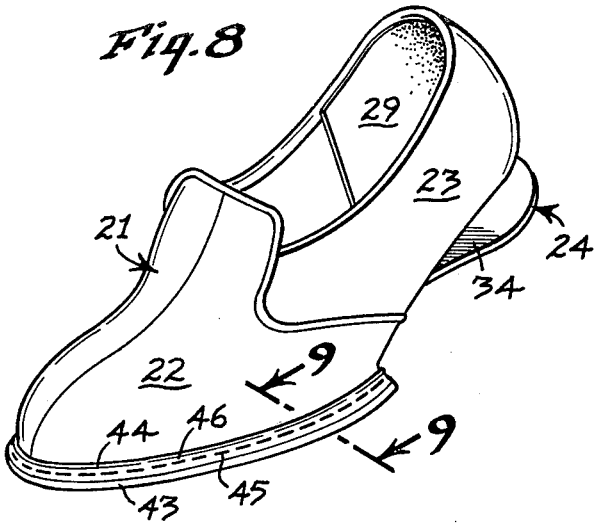
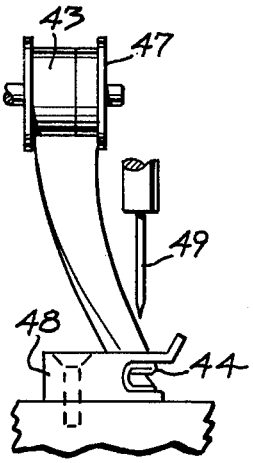
Fig. 10
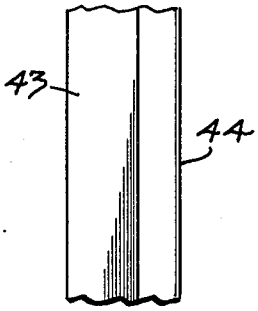
Fig. 11
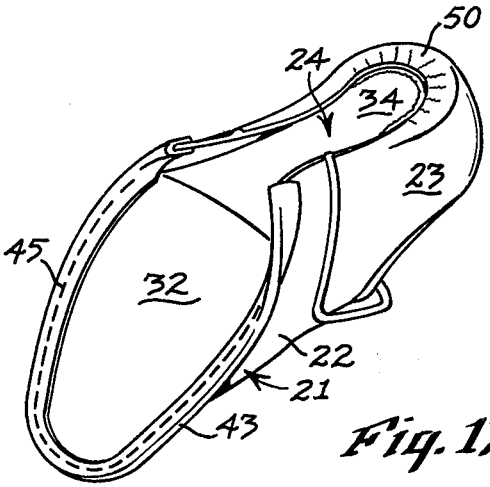
Fig. 12
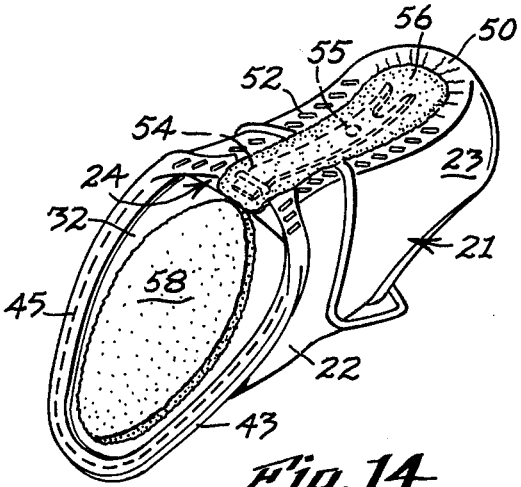
Fig. 14
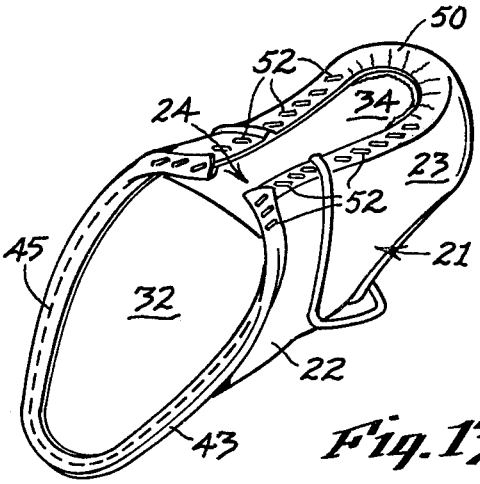
Fig. 13

SHOE CONSTRUCTION

BACKGROUND OF THE INVENTION

This invention relates to a shoe construction and method, and more particularly to the construction of a more comfortable, leisure-type shoe.

The method of constructing a welt shoe is well-known, as illustrated on pages 448 and 449 of Vol. 16 of the Encyclopedia International, 1st Edition, Grolier, Inc., 1964.

The methods of "slip-lasting" and "stitchdown" are also known as described on page 450 of the above Vol. 16 of the Encyclopedia International.

Backpart cement lasting and side lasting by stapling are also well-known in the art.

Shoes having relatively flexible soles are also known and available on the market.

SUMMARY OF THE INVENTION

It is an object of this invention to provide a shoe construction in which the forepart of the shoe is provided with a simulated welt-look for attractiveness in appearance, as well as a flexible and more comfortable shoe incorporating one or more padded insert members.

This shoe construction incorporates a pre-formed upper having an outwardly directed peripheral flange on the forepart of the upper, which is stitched or otherwise secured, flush against the top face of the marginal portion of the insole. Preferably, a padded insert member is secured to the insole by a cover sheet having its marginal edges stitched to the marginal portion of the forepart of the insole prior to the attachment of the upper.

A binding tape having substantially the same length as the periphery of the flange of the forepart of the upper is folded along its longitudinal axis, fitted over the free edges of the flange and marginal portion of the insole, and stitched in place completely around the margin of the forepart of the upper.

The backpart of the upper is secured to the backpart of the insole by conventional lasting means, such as cement and/or staples.

A conventional shank is fixed to the lower face of the middle of the insole as well as the conventional filler material. A second cushion member is preferably secured to the bottom face of the insole before the outsole is secured by adhesive to the insole, sandwiching between the insole and the outsole, the shank, filler material and the second cushion member.

The forepart of the margin of the outsole is then lock-stitched to the forepart margin of the insole, upper, and the overlapping portions of the folded binding tape.

The heel member is then secured in a conventional manner to the heel portion of the insole, and a sock liner, preferably having a third padded member fixed to its lower backpart face is inserted and fitted into the shoe to rest upon the cover sheet and insole, so that the entire length of the insole of the shoe is covered by resilient or padded material for the comfort of the wearer's foot.

The folded exterior taper member around the forepart of the shoe provides a very attractive welt-look, as well as a very durable construction.

Where the padded member is secured to the upper face of the insole by a cover sheet, the cover sheet is secured by four lines of stitching. The flange of the upper is secured to the margin of the insole by three lines of stitching. The tape is secured to the insole by two lines of stitching. The outsole is secured to the insole by one line of lockstitching and, preferably, by adhesive.

BRIEF DESCRIPTION OF THE DRAWINGS

FIG. 1 is a top perspective view of the insole incorporated in the shoe construction of this invention;

FIG. 2 is a top perspective view of the insole, including the forepart padded member, with a portion of the cover sheet broken away;

FIG. 3 is a section taken along the line 3—3 of FIG. 2;

FIG. 4 is a top perspective view of the padded insole disclosed in FIG. 2, after the insole has been molded to fit the last;

FIG. 5 is an exploded perspective view of the completed upper before it is secured to the padded insole;

FIG. 6 is a top perspective view of the forepart of the upper stitched to the forepart of the padded insole;

FIG. 7 is an enlarged fragmentary section taken along the line 7—7 of FIG. 6;

FIG. 8 is a top perspective view of the upper and insole having the binder tape stitched around the forepart thereof;

FIG. 9 is an enlarged fragmentary section taken along the line 9—9 of FIG. 8;

FIG. 10 is an elevational schematic view of the sewing needle and the gauge for stitching the binding tape to the marginal portions of the upper and insole;

FIG. 11 is an enlarged, fragmentary, plan view of the binding tape;

FIG. 12 is a bottom perspective view of the upper and insole, illustrating the cement-lasting of the heel portion;

FIG. 13 is a view similar to FIG. 12 illustrating the side lasting of the upper;

FIG. 14 is a view similar to FIG. 13 illustrating the addition of the shank and filler material to the insole;

DESCRIPTION OF THE PREFERRED EMBODIMENT

Figure 19:
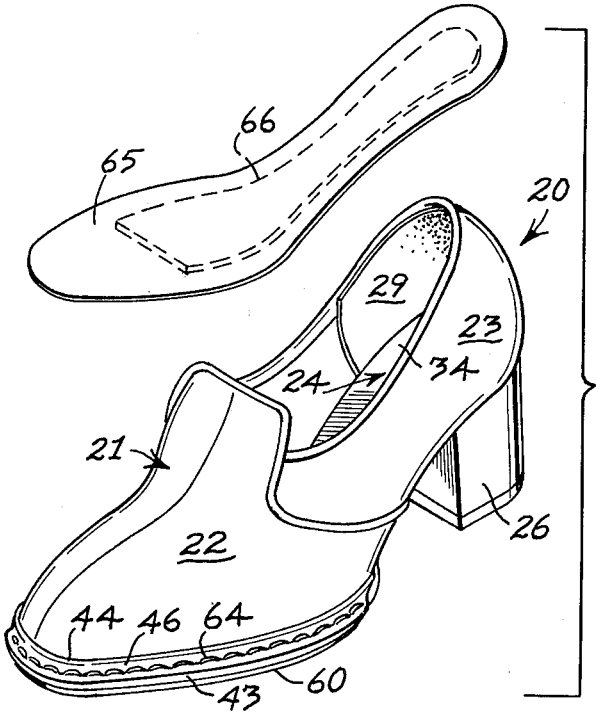
FIG. 19 is an exploded perspective view of the sock liner before it is inserted into the finished shoe.

Referring now to the drawings in more detail, the shoe 20 disclosed in FIG. 19 basically includes an upper 21 having a forepart 22 and a backpart 23, an insole 24, an outsole 60 and a heel 26.

In the manufacture of the shoe 20, the pieces of the upper 21 are first cut out in the desired patterns and stitched together in a conventional manner, as disclosed in FIGS. 5 and 6. As disclosed in FIG. 5, the interior of the forepart 22 is provided with a boxtoe 28, while the interior of the backpart 23 is provided with a counter 29, in a conventional manner. It will also be noted in FIG. 5 that the lower edge of the upper forepart 22 is provided with depending spaced projections 30.

The insole 24 is formed from a somewhat flexible material with an oversized forepart margin. In other words, the forepart 32 of the insole 24 has a margin or periphery which extends outwardly slightly more than a conventional insole. Furthermore, the margin of the insole forepart 32 is provided with notches 33 adapted to register with the depending projections 30 from the upper forepart 22.

As disclosed in FIG. 1, the insole 24 includes the forepart 32 and a backpart 34, originally made separately and having their overlapping middle edge portions laminated or adhesively secured together. In this form of the invention, the backpart is a relatively stiff or rigid material, such as paperboard, or rigid plastic. On the other hand, the forepart 32 is made of a much more supple or flexible material, such as a thin plastic material.

The next step in this process is to place a padded member 35, such as a foam material, substantially coextensive with the forepart 32, flat upon the top surface of the insole forepart 32, and then secure the padded member 35 to the forepart 32 by a cover member 36, preferably made of a flexible fabric. The cover material 36 is coextensive with the insole forepart 32, and the margin portion of the cover 36 is stitched to the margin portion of the insole forepart 32 by a line of stitching 37 approximately 1/16 of an inch inward and parallel to the outer edge of the insole forepart 32, as viewed in FIG. 2.

The insole 24 with the cover 36 and foam pad 35 secured to the insole 24 are then formed in a mold, not shown, to fit the last, as illustrated in FIG. 4.

The foam-padded insole 24 is now ready to receive and be secured to the upper 21, as illustrated in FIG. 5. After the projections 30 are in registered engagement with the slots 33 in the margin of the insole 24, the marginal flange 40 of the upper forepart 22 is fitted flush against the top marginal portion of the cover 36 and the insole forepart 32, and secured thereto by a line of stitching 41. This line of stitching 41 is sewn entirely around the margin of the forepart of the insole 24 and spaced inward from the edge of the insole 24 and the upper forepart 22 a substantially uniform distance of ⅛th of an inch. Accordingly, the line of stitching 41 not only secures the upper 22 to the insole 24, but also sandwiches therebetween the marginal portion of the cover 36. Thus, the cover 36 is secured by double stitching to the insole 24, as best disclosed in FIG. 7.

Referring now to FIGS. 8–11, a length of flexible, flat binding tape, also preferably of plastic material, is cut or formed to extend longitudinally the length of the peripheral margin of the forepart of the insole. The tape 43 is preferably about 1 inch wide, with a ¼-inch strip folded over to form the finished edge 44. Thus, the width of the finished binding tape is ¾ths of an inch.

With the finished edge 44 uppermost, the finished binding tape 43 is folded lengthwise approximately along its center line and fixed over the exposed marginal edge of the upper flange 40 and the marginal edge of the insole 24. Preferably, as the finished binding tape is folded over the marginal edges progressively, the binding tape 43 is stitched by a line of stitching 45 spaced substantially uniformly from the outer edge of the insole 24 a distance of approximately ⅛th of an inch. The tape 43 is folded in such a manner that the finished edge 44 turns upward and is spaced from the line of stitching 45 approximately ⅛th of an inch, as best disclosed in FIG. 9. The line of stitching 45 of course, extends not only through the upper portion of the binding tape 43, but also through the upper flange 40, marginal portion of the cover material 36, marginal portion of the insole 24, and the bottom or lower layer of the tape 43. Thus, the upper flange 40 and insole 24 are secured together by a double line of stitching, while the cover 36 is now secured by a triple line of stitching 37, 41 and 45.

One preferred method of stitching the binding tape 43 to the marginal flange 40 and insole 24 is disclosed in FIG. 10. The finished tape 43 is supported upon a spool 47 and is fed through a specially designed gauge 48 to fold the tape to fit around the marginal flange 40 and margin of the insole 24, for subsequent stitching by the sewing needle 49.

The stitched binding tape with the upwardly turned portion 46 provides not only an additional means of securing the upper 21 to the insole 24, but also provides an attractive welt-look to the forepart of the finished shoe 20.

The upper 21 is then preferably set under a heating unit to soften up the boxtoe 28 and to activate the counter 29. After the upper is sufficiently warmed, the backpart 34 of the insole 24 is pressed inward to occupy a position within the upper backpart 23. The forepart 22 of the upper is slipped upon the last (not shown) in a conventional one-half, slip-lasted style. The lasted shoe is then placed into a backpart molding machine of conventional construction and actuated to cement-last the rear marginal heel portion 50 of the upper backpart 23 to the corresponding lower surface of the insole backpart 34, as best disclosed in FIG. 12.

The remaining lower marginal portions of the sides of the upper 21 are then side-lasted to the intermediate portion of the insole backpart 34, preferably by staples 52, as best disclosed in FIG. 13. The staples 52 are also employed to secure any trailing ends of the tape 43 to the insole 24.

After the upper 21 is side-lasted, the incomplete shoe is again moved through a heat setting machine to heat-set the upper 21 to the last, in order to smooth out any wrinkles in the upper 21.

The bottom of the insole is then roughened to facilitate cementing to the outsole. The steel shank 54 is set in place by a tack 55 and the bottom filler material 56, preferably made of conventional sawdust and glue, is applied to fill in the space around the shank 54 and between the margins of the sides and heel portions of the upper 21, in a conventional manner.

A second foam insert or padded member 58 covering a major portion of the forepart 32 of the insole may be formed and secured to the lower surface of the insole forepart 32 by suitable adhesive, as disclosed in FIG. 14, to provide an additional cushioning effect for the ball of the foot within the forepart of the shoe.

Figure 15:
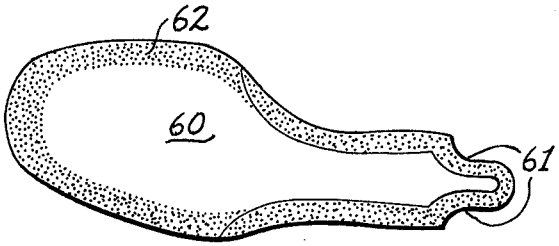
FIG. 15 is a top plan view of the outsole.
Figure 16:
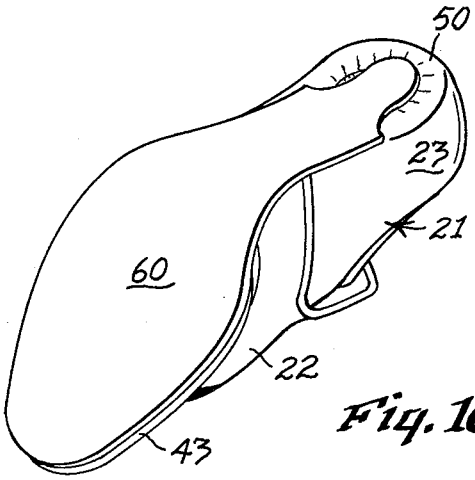
FIG. 16 is a bottom perspective view illustrating the outsole secured to the insole.

The outsole 60 disclosed in FIG. 15 is formed preferably by die-cutting, and pre-trimming, if necessary. The edges of the outsole 60 are coated with an ink or coloring material. Recesses 61 are cut out of the heel portion, and the upper marginal surface portions are coated with an appropriate adhesive 62 for securing to the bottom portion of the incomplete shoe disclosed in FIG. 14. The outsole 60 is then laid in its proper position upon the bottom of the incomplete shoe and cement-lasted to the inturned marginal portions of the upper 21 and to the bottom layer of the binding tape 43, as disclosed in FIG. 16.

The last is then pulled from the upper 21 and the forepart margin of the outsole 60 is stitched by a "Goodyear Lockstitching Machine". The line of lockstitching 64 secures together the corresponding marginal portion of the insole forepart 32 and the upper flange 40, as well as the upper and lower overlapping layers of the binding tape 43 and the marginal portion of the cover material 36, as best disclosed in FIG. 18.

Figure 18:
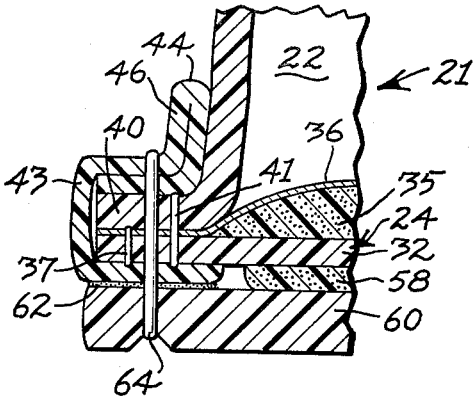
FIG. 18 is an enlarged, fragmentary section taken along the line 18—18 of FIG. 17.
Figure 17:
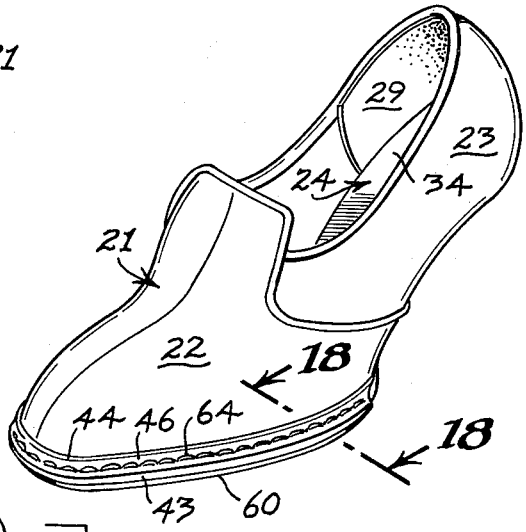
FIG. 17 is a top perspective view illustrating the lockstitching of the foreparts of the upper, tape, insole and outsole.

At this stage of the construction, the outsole 60 is doubly secured by the adhesive 62 and the lockstitching 64 to the insole 32. The binding tape 43 is also doubly secured to the upper flange 40 and insole 32 by two lines of stitching 45 and 64. The upper flange 40 and the margin of the insole 32 are now secured by three lines of stitching 64, 45, and 41. In FIG. 18, the tape stitching 45 is hidden behind the lockstitching 64. The cover material 36 is now secured by four rows of stitching 64, 45, 41 and 37. After the lockstitching step 64, the upturned, finished edge 44 of the tape 43 is turned up to a more pronounced degree, as contrasted with the process stage disclosed in FIG. 9, and therefore provides an even more pronounced attractive welt-look feature, as disclosed in FIGS. 17 and 19.

After the lockstitching step, the incomplete shoe is again re-lasted and again passed through the heat-setting machine to eliminate any boxtoe or counter distortion, which may have occurred in handling while stitching. The last is then pulled and the heel 26 nailed on in a conventional manner. The shoe 20 is then sock-lined with a conventional sock liner 65, to the bottom of which has preferably been secured by an adhesive a third elongated padded member 66, preferably of a plastic foam material, and which preferably is designed to cover particularly the heel and shank areas of the insole. As disclosed in FIG. 19, the padded foam member 66 extends from approximately the ball of the foot to the heel. Thus, when the sock liner 65 is slipped into the shoe 20, the entire insole of the shoe 20 is completely padded, and is double-padded in the forepart of the shoe if the padded member 58 is incorporated on the bottom of the insole forepart 32.

The softness of the wearer's step provided by the cushion or padded members minimizes abrasion of the outsole on the walking surface, and thereby provides for a longer lasting shoe.

Thus, the shoe 20 made in accordance with this process is extremely comfortable, flexible and durable, as well as having an attractive appearance. By virtue of the flexibility of the upper and the insole, as well as the outsole, the shoe 20 is quite flexible, not only for comfort, but also for folding or collapsing for reduced storage space either at home or in traveling.

The folded and lockstitched tape around the forepart of the shoe provides an attractive, finished appearance simulating a welt-type shoe. Not only do the tape and lockstitching improve the appearance of the shoe, but also the plural stitching around the forepart of the shoe provides a very strong and lasting shoe construction.

Shoes made in accordance with this process may be constructed for men's, women's and children's footwear. The construction may be adapted for various shoe styles, such as those having closed toes and closed heels, closed toes and open heels, closed toes and open shanks and open heels, as well as mules, scuffs and loafers. The outsole 60 may be in the form of a crepe outsole which can be stitched or cemented to the lower margins of the lasted upper.

Although the material of the upper 21 is not important, the preferred form of upper currently used in the shoe 20 is made from a urethane material which has a laminated inner fabric lining surface, so that no additional liner is required.

The sole material is a conventional sole material, such as a rubber or plastic composition.

What is claimed is:

1. In a shoe construction, a. an insole having a top face, a bottom face, an outer edge, a forepart, a forepart marginal portion, and a backpart, b. a first padded member substantially coextensive with and covering the top face of the forepart of said insole, c. a cover sheet over said first padded member and coextensive with the forepart of said insole, d. a first line of cover stitching securing the margin of said cover sheet to the forepart marginal portion of said insole and being spaced inward approximately 1/16th of an inch from the outer edge of said insole, e. an upper having a forepart marginal flange fitting flush against said forepart marginal portion, f. an elongated binding tape extending the length of said forepart marginal flange, g. said tape being folded about its longitudinal axis over the free edges of said forepart marginal portion and flange, said folded tape having a lower portion covering said forepart marginal portion and an upper portion covering said forepart marginal flange, h. a second line of stitching securing together the upper portion of said tape, said forepart marginal flange, said cover sheet, said forepart marginal portion of said insole, and the lower portion of said tape, said second line of stitching being spaced inward from said first line of stitching, i. an outsole fitting against said insole and having a marginal portion fitting against said lower portion of said folded tape, and j. means securing said outsole to said insole.

2. The invention according to claim 1 further comprising a third line of stitching securing together said marginal flange and the marginal portion of said insole and spaced inward from said first line of stitching.

3. The invention according to claim 2 in which the third line of stitching is spaced inward from the outer edge of said insole approximately ⅛th of an inch.

4. The invention according to claim 1 in which said means for securing the outsole to the insole comprises a fourth line of stitching securing the upper and lower portions of the folded tape, said forepart marginal flange, said forepart marginal portion of said insole, and said outsole.

5. The invention according to claim 1 further comprising a second padded member substantially coextensive and fixed to the forepart bottom face of said insole between said insole and said outsole.

6. The invention according to claim 1 further comprising a sock liner coextensive with said insole and fitted within said upper, the forepart of said sock liner resting on said cover sheet, and a third padded member fixed to the bottom of the backpart of said sock liner and fitted between said sock liner and said insole.

* * * * *